US006876351B2

(12) United States Patent
Tokonami et al.

(10) Patent No.: US 6,876,351 B2
(45) Date of Patent: Apr. 5, 2005

(54) LIQUID CRYSTAL DISPLAY APPARATUS AND DRIVING METHOD THEREFOR

(75) Inventors: Susumu Tokonami, Kikuchi-gun (JP); Susumu Shibata, Kikuchi-gun (JP); Hironori Aoki, Kikuchi-gun (JP); Shingo Nagano, Kikuchi-gun (JP)

(73) Assignee: Advanced Display Inc., Kikuchi-gun (JP)

( * ) Notice: Subject to any disclaimer, the term of this patent is extended or adjusted under 35 U.S.C. 154(b) by 105 days.

(21) Appl. No.: 10/307,434

(22) Filed: Dec. 2, 2002

(65) Prior Publication Data

US 2003/0076289 A1 Apr. 24, 2003

Related U.S. Application Data

(62) Division of application No. 09/353,833, filed on Jul. 15, 1999, now Pat. No. 6,515,646.

(30) Foreign Application Priority Data

Jul. 17, 1998 (JP) ..... 10-203726

(51) Int. Cl.[7] ..... G09G 3/36
(52) U.S. Cl. ..... 345/94; 345/96; 345/95
(58) Field of Search ..... 345/92–96, 98–100, 345/204, 690

(56) References Cited

U.S. PATENT DOCUMENTS

| | | | | |
|---|---|---|---|---|
| 5,073,826 A | * | 12/1991 | Muraji et al. | 386/44 |
| 5,724,060 A | * | 3/1998 | Graham et al. | 345/97 |
| 5,867,141 A | * | 2/1999 | Asada et al. | 345/100 |
| 5,900,854 A | * | 5/1999 | Itoh et al. | 345/99 |
| 6,040,826 A | * | 3/2000 | Furukawa | 345/534 |
| 6,064,358 A | * | 5/2000 | Kitajima et al. | 345/88 |
| 6,128,045 A | * | 10/2000 | Anai | 348/556 |
| 6,229,515 B1 | * | 5/2001 | Itoh et al. | 345/103 |
| 6,515,646 B2 | * | 2/2003 | Tokonami et al. | 345/96 |

* cited by examiner

*Primary Examiner*—Ricardo Osorio
(74) *Attorney, Agent, or Firm*—Oblon, Spivak, McClelland, Maier & Neustadt, P.C.

(57) ABSTRACT

The present invention is directed to a liquid crystal display apparatus including: a timing circuit for operating a shift register within a timing circuit during a vertical blanking period such that a common signal that has been alternated at a cycle of a Single Horizontal period is applied on counter electrodes during the vertical blanking period and such that a storage electrode signal is applied on storage electrodes having a frequency, phase and amplitude identical to those of the common signal.

2 Claims, 17 Drawing Sheets

FIG. 8(a)
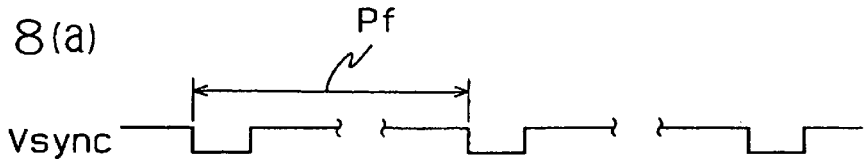
FIG. 8(b)
FIG. 8(c)
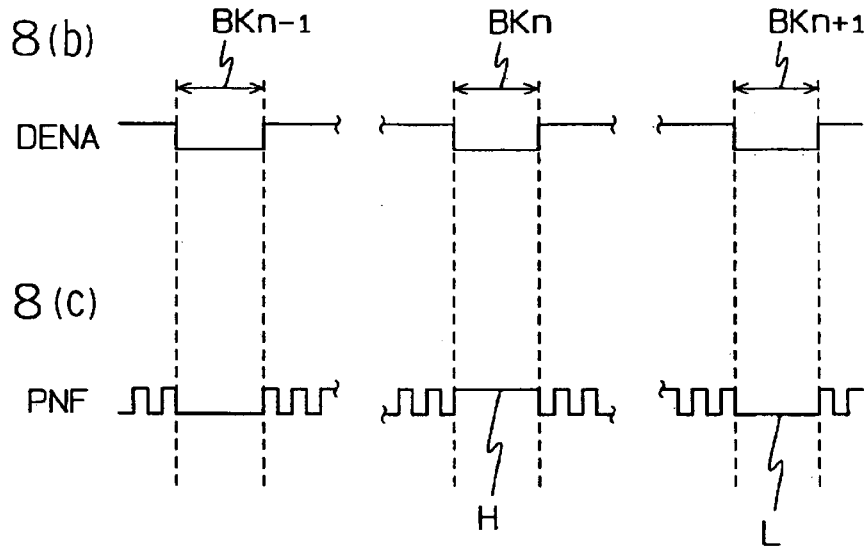

BKn-1
BKn
BKn+1
81a
81b

Vd:even
Vd:odd
Vd:even

Vcom
V1
V2

Vd:odd
Vd:even
Vd:odd
81c
81d

Vd:even
Vd:odd
Vd:even

Vcom

Vd:odd
Vd:even
Vd:odd

LIQUID CRYSTAL DISPLAY APPARATUS AND DRIVING METHOD THEREFOR

BACKGROUND OF THE INVENTION

The present invention relates to a liquid crystal display apparatus of active matrix type and a driving method therefor.

FIG. 13 is a diagram of a driving circuit of a conventional active matrix type liquid crystal display apparatus as described in Japanese Unexamined Patent Publication No. 313607/1993. In this diagram, a plurality of X electrode lines ($X_{i-1}$, $X_i$, $X_{i+1}$ . . . ) and Y electrode lines ($Y_{j-1}$, $Y_j$, $Y_{j+1}$ . . . ) are arranged in a form of a matrix, and active elements 11 and liquid crystal elements 12 such as TFT (thin film transistors) are formed on intersections of each of the X electrode lines and Y electrode lines. The Y electrode lines are also called data lines and are connected to a display signal circuit 13 for outputting display data signals for each of the liquid crystal display elements 12. Further, the X electrode lines are also called scanning signal lines and are connected to a scanning signal circuit 14 for outputting scanning signals.

The counter side of the liquid crystal display elements 12 are connected to a common electrode 15. The driving of the active elements 11 is performed in that the active elements 11 on the X electrode lines are set to at ON conditions (active conditions) synchronously with the scanning of the X electrode lines, in that display data signals are output from the display signal circuit 13, and in that data signals are written into corresponding liquid crystal display elements 12 via the active elements 11 in ON conditions. It should be noted that there have also been taken measures in which storage capacitances 16 are provided, upon requirement, for the liquid crystal display elements 12 in order to improve storage characteristics of electrical charge of the liquid crystal display elements 12.

An example of a conventional driving method for an active matrix type liquid crystal display apparatus is disclosed in Japanese Unexamined Patent Publication No. 141269/1994, and FIG. 14 is a view showing an example of a timing chart for indicating the driving method. As known, liquid crystal need to be driven through alternating-current, whereby an electric potential 111 of the signal line is made to be an image signal performing alternating-current inversion with a certain electric potential Vc being the center. During vertical scanning period T1, an electric potential 112 of a scanning line becomes high-leveled by a single scanning period T3. Such a scanning pulse is sequentially applied from above the screen per scanning line. T2 denotes a vertical blanking period (hereinafter also referred to as mere "blanking period") in which usually no image signals are applied. An electric potential of a counter electrode 113 is set to be lower than the central electric potential Vc of the image signal in case of N channel TFTs.

It will now be explained for a line common inversion driving method that is one of the objects of the present invention as a driving method for the above liquid crystal display apparatus. In a line common inversion driving method, two adjacent pixels are driven through alternating-current to be of opposite polarity, and this method is advantaged in that a driving IC of low cost may be employed and the power consumption can be decreased.

Driving waveforms of a conventional TFT-LCD employing the line common inversion method is shown in FIG. 15 and FIG. 16. FIG. 15 is a view of driving waveforms of odd-numbered lines and FIG. 16 of driving waveforms of even-numbered lines, respectively. In FIGS. 15 and 16, Vd denotes electric potentials of drain electrodes (broken line of short pitches), Vcom electric potentials of the counter electrodes (thin real line), Veff voltage applied onto the liquid crystal (potential differences between Vd and Vcom are shown by the hatching), Vg electric potentials of the gate lines including voltage at the time of gate OFF Vgl and voltage at the time of gate ON Vgh. Vs denotes electric potentials of source lines (broken line of long pitches). In case the reference marks Vcom, Vg, Vs are indicated in connection with the word "signal" such as "Vcom signal", these represent signals having electric potentials of counter electrodes. Further, DA denotes data period, and BK blanking period, respectively. The effective voltage Veff that is applied on the liquid crystal corresponds to a root-mean-square of a single frame period of an electric potential difference between Vd and Vcom. The Vd varies per Single Horizontal period (1H) depending on the Vcom, Vg and Vs signals.

In alternating-current driving based on a line common inversion method, Vg is controlled by the scanning signal circuit, Vs by the display signal circuit, Vcom by a timing control circuit and a power source circuit (not shown), while Vd is determined by the Vg, Vs and Vcom. A Single Horizontal period (1H) is approximately 32 $\mu$s in case of VGA, approximately 26 $\mu$s in case of SVGA, and 20 $\mu$s in case of XGA, and a value for each of the electric potentials Vgh is set to be a voltage with which charge/discharge of electric charge of the drain electrodes can be completed within 1H, that for Vgl to be a voltage with which the electric charge of the drain electrodes can be sufficiently held during a single frame period, and those for Vs and Vcom to be a voltage with which display can be performed at a desired luminance.

Since this variation is repeated per 1H during the data display period, the Veff of the odd-numbered lines and even-numbered lines can be set to be identical by optimizing the central value for the Vcom. However, since the Vcom, Vgl and Vs signal are usually not varied but remain fixed during the blanking period, the drain variation at the start of the blanking period is maintained during the blanking period whereby luminance differences are generated line by line owing to the different values for the Veff of the odd-numbered lines and even-numbered lines during the blanking period as shown in FIG. 15 and FIG. 16. The relationship between Vd and Vcom will now be explained. As shown in FIG. 17, the electric potential Vd of the pixel electrodes (drain electrodes) changes owing to effects of variations in (1) electric potential Vcom of the counter electrodes 22, (2) electric potential of a storage electrodes 23, and (3) electric potential Vs of the source electrodes in a holding condition of the TFTs 21. However, the electric potential of the storage electrode is determined by the Vg, Vcom and other factors, and a signal identical in amplitude and polarity with those of the Vcom (while the DC values may be different) is applied. In this manner, since the alternation of (1) to (3) is terminated during the blanking period, it may happen that the luminance differences of brightness between odd-numbered lines and even-numbered lines are generated.

SUMMARY OF THE INVENTION

The present invention has been made to solve such problems, and it is an object thereof to provide a liquid crystal display apparatus and a driving method therefor in which TFT driving signals during blanking periods are optimized to compensate for effective voltage differences during vertical blanking periods between odd-numbered lines and even-numbered lines and to decrease luminance differences per gate line.

In order to compensate for effective voltage differences during the afore-mentioned vertical blanking period, the present invention employs a means to perform alternation of the afore-mentioned (1) electric potential Vcom of counter electrodes 22, (2) electric potential of storage electrodes 23, and (3) electric potential Vs of source electrodes also during the blanking period as it is similarly performed during the data period. However, it is also possible to perform alternation of only one of (1), (2) and (3) during the blanking period or to combine some of these. It will now be shown that variations in the Vcom and Cs electrodes are corresponding in a set with respect to each other. Variations in the Vd in case of TFT-OFF conditions are dominated by the coupling of signals that are transmitted through three capacitance C1*c*, Cs, Csd as shown in FIG. 16 whereby it is desirable to set the conditions of signal coupling for these to be identical with those of the data period. Since the Vd is floating during the TFT-OFF condition, the electric potential of the Cs electrode needs to vary similarly to Vcom in order to maintain a voltage that is applied on the C1*c* with respect to the Vcom that is to be alternated constant (note that the DC values may be different). Therefore, variations in the Vcom and Cs electrodes are always in subordinate relations and should be considered as a set.

Japanese Unexamined Patent Publication No. 141269/1994 suggests a method in which an alternating-current voltage exceeding a threshold for liquid crystal is applied on signal lines or scanning lines in order to solve such problems during the vertical blanking period. However, the technique disclosed in this publication is merely directed to the subject of coping with display deficiencies owing to defects caused by shorting of signal lines and pixel electrodes which stand out during the vertical blanking period in which no voltage is applied, and it is not suitable to achieve the purpose of the present invention to decrease luminance differences per line.

In order to achieve the afore-mentioned purpose of the present invention, the liquid crystal display apparatus according to one embodiment of the present invention comprises a timing circuit for operating a shift register within a timing circuit during a vertical blanking period such that a common signal that has been alternated at a cycle of a Single Horizontal period is applied on counter electrodes during the vertical blanking period and such that a storage electrode signal is applied on storage electrodes having a frequency, phase and amplitude identical to those of the common signal.

The liquid crystal display apparatus comprises either an array substrate having a wiring arrangement in which gate lines concurrently serve as storage capacitances or an array substrate having a wiring arrangement in which common lines concurrently serve as storage capacitances.

The liquid crystal display apparatus comprises a timing circuit for operating a shift register within the timing circuit during a vertical blanking period such that a source signal that has been alternated at a cycle of a Single Horizontal period is applied on source lines during the vertical blanking period.

The liquid crystal display apparatus according to another embodiment of the present invention comprises a timing circuit in which a polarity inverting signal is at least one inverted during a vertical blanking period such that a variable common signal, which voltage is at least once varied during the vertical blanking period, is generated and applied on counter electrodes, and such that a variable storage electrode signal, which is varied to assume a polarity identical with the variable common signal and by an identical amplitude synchronously with the variable common signal, is generated and applied on storage electrodes.

The liquid crystal display apparatus according to still another embodiment of the present invention comprises a timing circuit in which a polarity inverting is at least one inverted during a vertical blanking period such that a signal a variable source signal, which voltage is at least once varied during the vertical blanking period, is generated, and such that the variable source signal is applied on the source lines.

The liquid crystal display apparatus according to another embodiment of the present invention comprises a timing circuit in which Gray level data are generated as data for a line following a last line, and wherein a Gray level source signal is applied on source lines during the vertical blanking period.

According to the liquid crystal display apparatus according to another embodiment of the present invention, the liquid crystal display apparatus (a) comprising a timing circuit in which a common signal and a storage electrode signal having a frequency, phase and amplitude identical to those of the common signal are generated to be of same polarity by fixing a polarity inverting signal either to H or L during each of the vertical blanking periods, and (b) wherein a common signal of same polarity is applied on counter electrodes during each of the vertical blanking periods and the storage electrode signal is applied on storage electrodes.

According to the liquid crystal display apparatus according to another embodiment of the present invention, the liquid crystal display apparatus (a) comprising a circuit in which a common signal and storage electrode signal of a frequency, phase and amplitude identical to those of the common signal are generated by amplifying a polarity inverting signal, wherein an intermediate electric potential common signal having a potential that is between a maximum peak value and minimum peak value for an amplitude during a data period is generated by setting an amplifying rate to zero, and wherein an intermediate electric potential storage electrode signal having an intermediate electric potential that is between a maximum peak value and a minimum peak value for the amplitude during the data period synchronously with the intermediate electric potential common signal is generated, and (b) wherein the intermediate potential common signal is applied on counter electrodes during the vertical blanking period and the intermediate potential storage electrode signal is applied on storage electrodes during the vertical blanking period.

In the driving method for a liquid crystal display apparatus according to one embodiment of the present invention, a common signal is alternated at a cycle of a Single Horizontal period and applied on counter electrodes, and a storage electrode signal having a frequency, phase and amplitude identical to those of the common signal is applied on storage electrodes during the vertical blanking period for decreasing effective voltage differences between odd-numbered lines and even-numbered lines and for decreasing luminance differences per gate line.

In the driving method for a liquid crystal display apparatus according to another embodiment of the present invention, a source signal that has been alternated at a cycle of a Single Horizontal period is applied on source lines during a vertical blanking period for decreasing effective voltage differences between odd-numbered lines and even-numbered lines and for decreasing luminance differences per gate line.

In the driving method for a liquid crystal display apparatus according to another embodiment of the present invention, a variable common signal, which voltage is at least once varied during a vertical blanking period, is generated and applied on counter electrodes, and a variable storage electrode signal, which is varied to assume a polarity identical with the variable common signal and by an identical amplitude synchronously with the variable common signal, is generated and applied on storage electrodes for decreasing effective voltage differences between odd-numbered lines and even-numbered lines and for decreasing luminance differences per gate line.

In the driving method for a liquid crystal display apparatus according to still another embodiment of the present invention, a voltage for a source signal is at least once varied during a vertical blanking period and applied on source lines for decreasing effective voltage differences between odd-numbered lines and even-numbered lines and for decreasing luminance differences per gate line.

In the driving method for a liquid crystal display apparatus according to another embodiment of the present invention, a source signal having a Gray level electric potential is applied on source lines during a vertical blanking period for decreasing effective voltage differences between odd-numbered lines and even-numbered lines and for decreasing luminance differences per gate line.

In the driving method for a liquid crystal display apparatus according to still another embodiment of the present invention, a common signal and storage electrode signal are set to be of same polarity, wherein the common signal is applied on counter electrodes and the storage electrode signal on storage electrodes during each of the vertical blanking period for decreasing effective voltage differences between odd-numbered lines and even-numbered lines and for decreasing luminance differences per gate line.

In the driving method for a liquid crystal display apparatus according to another embodiment of the present invention, a common signal having an intermediate electric potential that is between a maximum peak value and minimum peak value for an amplitude during a data period is applied on counter electrodes during a vertical blanking period, and a storage electrode signal having an intermediate electric potential that is between a maximum peak value and minimum peak value for the amplitude during the data period is applied, synchronous with the common signal, to storage electrodes during the vertical blanking period for decreasing effective voltage differences between odd-numbered lines and even-numbered lines and for decreasing luminance differences per gate line.

Embodiments of the present invention will now be discussed in details with reference to the accompanying drawings.

BRIEF DESCRIPTION OF THE DRAWINGS

FIG. 8 is an explanatory view showing a driving waveform of the liquid crystal display apparatus of EMBODIMENT 5;

DETAILED DESCRIPTION

Embodiment 1

Figure 1:
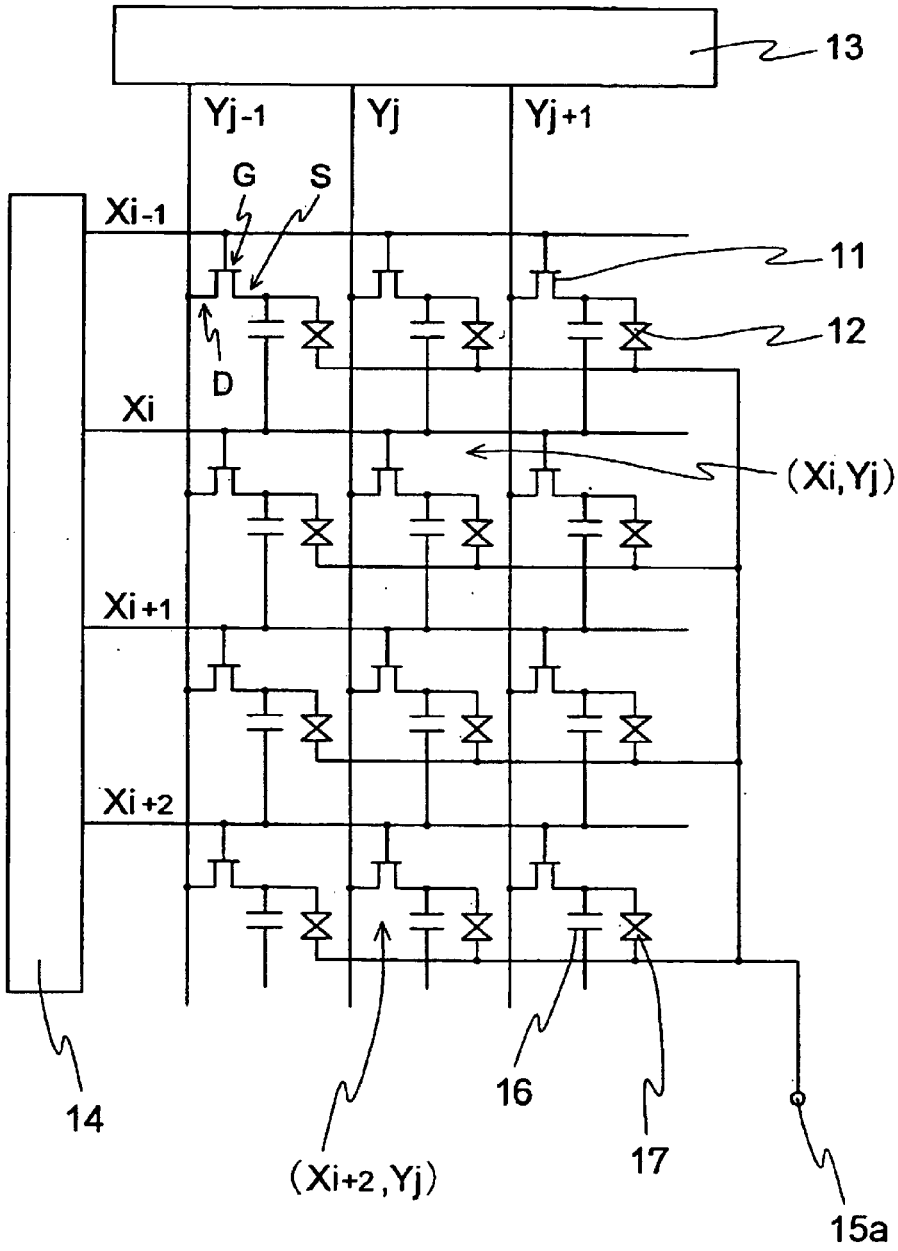
FIG. 1 is an explanatory view showing an equivalent circuit relative to the liquid crystal display apparatus of the present invention.
Figure 2:
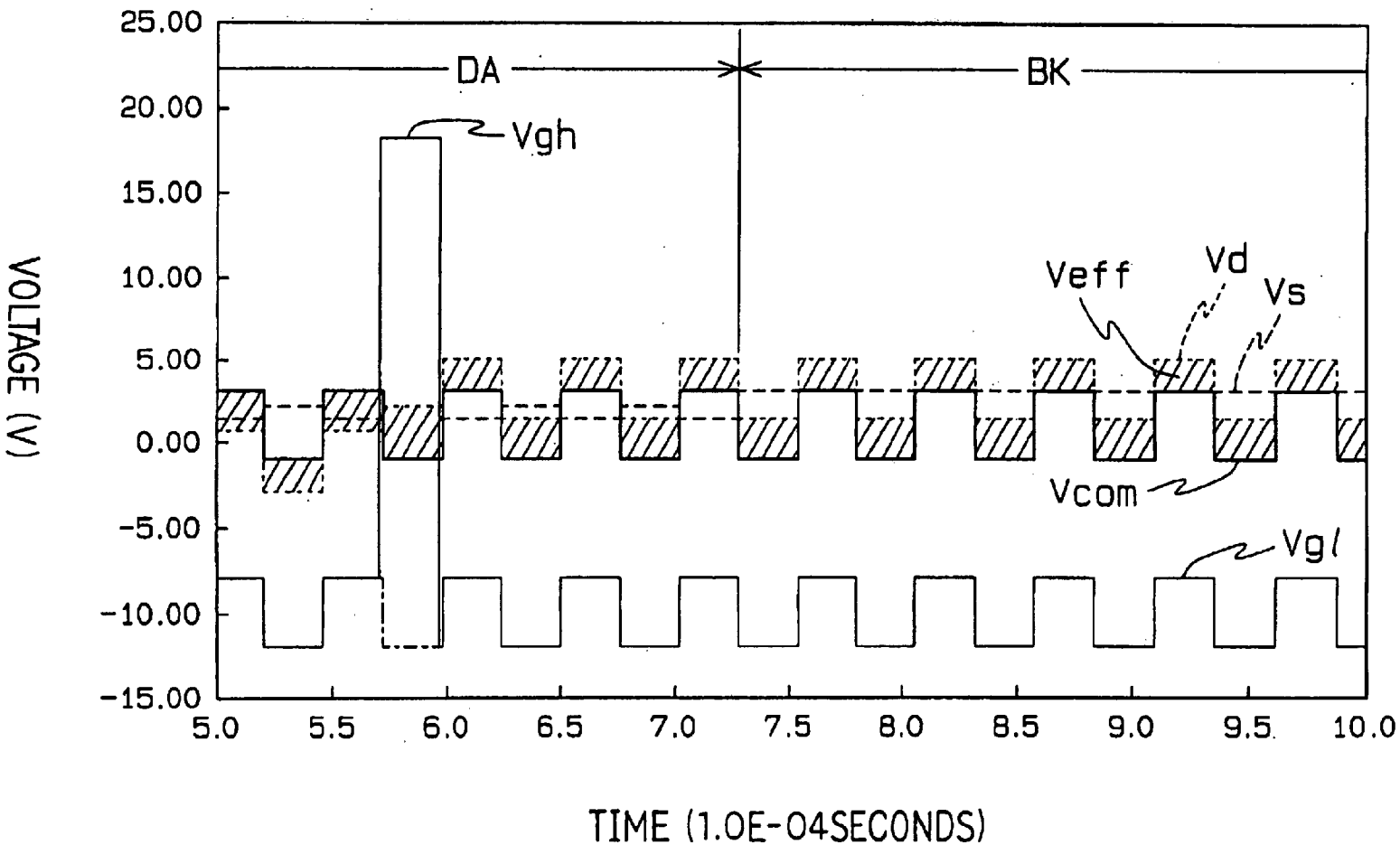
FIG. 2 is an explanatory view showing a driving waveform of the liquid crystal display apparatus of EMBODIMENT 1.
Figure 3:
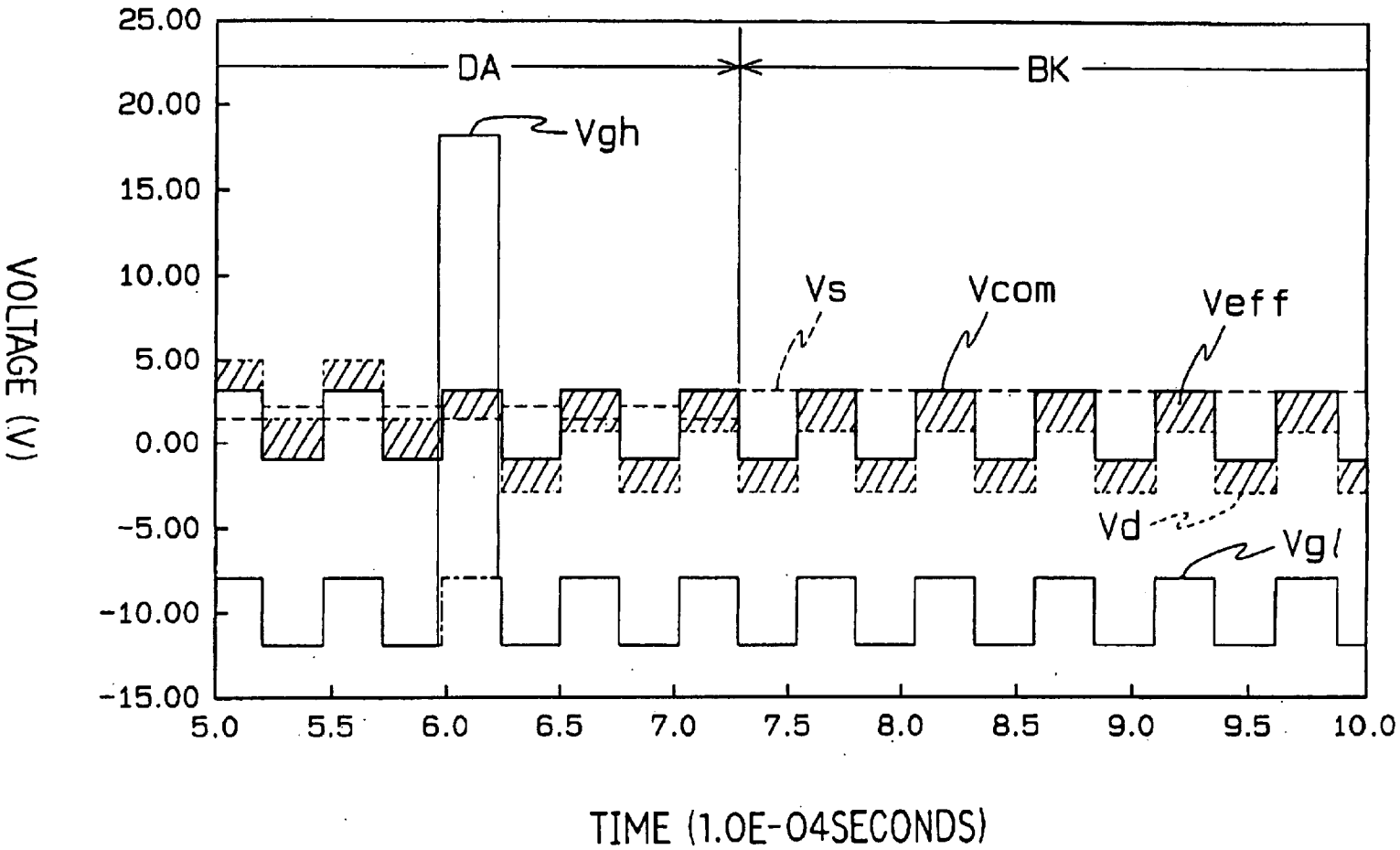
FIG. 3 is an explanatory view showing a driving waveform of the liquid crystal display apparatus of EMBODIMENT 1.

This embodiment will be explained based on a case in which a liquid crystal display apparatus of line common inversion method was used employing a panel having a wiring arrangement in which gate lines concurrently served as storage capacitances (hereinafter referred to as "Cs on Gate arrangement"), wherein the Vs remained as conventional ones and Vcom and Vgl were AC converted during the blanking period. Through this arrangement, signals applied on the gate lines were also applied on the storage capacitance electrodes (also called "storage electrodes"). FIG. 1 is a view of an equivalent circuit of an active matrix type liquid crystal display apparatus having a "Cs on Gate arrangement" according to the present invention. Further explanations will be eliminated since the same arrangement is employed in each of the following embodiments. FIG. 2 is an explanatory view of driving waveforms of odd-numbered lines (Gn+1 and n are even natural numbers) and FIG. 3 an explanatory view of driving waveforms of even-numbered lines (Gn), respectively. In these drawings, elements that are identical with those of FIGS. 13 to 17 are indicated by identical reference numerals or marks. Similarly to the data display period, Vcom and Vgl were varied per Single Horizontal period (1H) whereby effective voltage differences between odd-numbered lines and even-numbered lines can be decreased. For this purpose, the common signal was AC converted, applied on the counter electrodes 17 via common line 15*a*, and by applying a gate OFF signal having a frequency, phase and amplitude identical with those of the common signal on the gate lines, a storage electrode signal was applied on the storage electrodes 16. There are indicated in Table 1 effective voltage differences dV1*c* between Gn and Gn+1 (n-th line and n+1-th line of the gate) wherein dV1*c* values of a conventional liquid crystal display apparatus and dV1*c* values of the liquid crystal display apparatus according to the present invention have been compared (it should be noted that in the display condition, all pixel Gray level were displayed).

storage electrodes similarly to the above described embodiment also in case a panel other than of the afore-mentioned "Cs on Gate arrangement" is employed.

Embodiment 2

Figure 4:
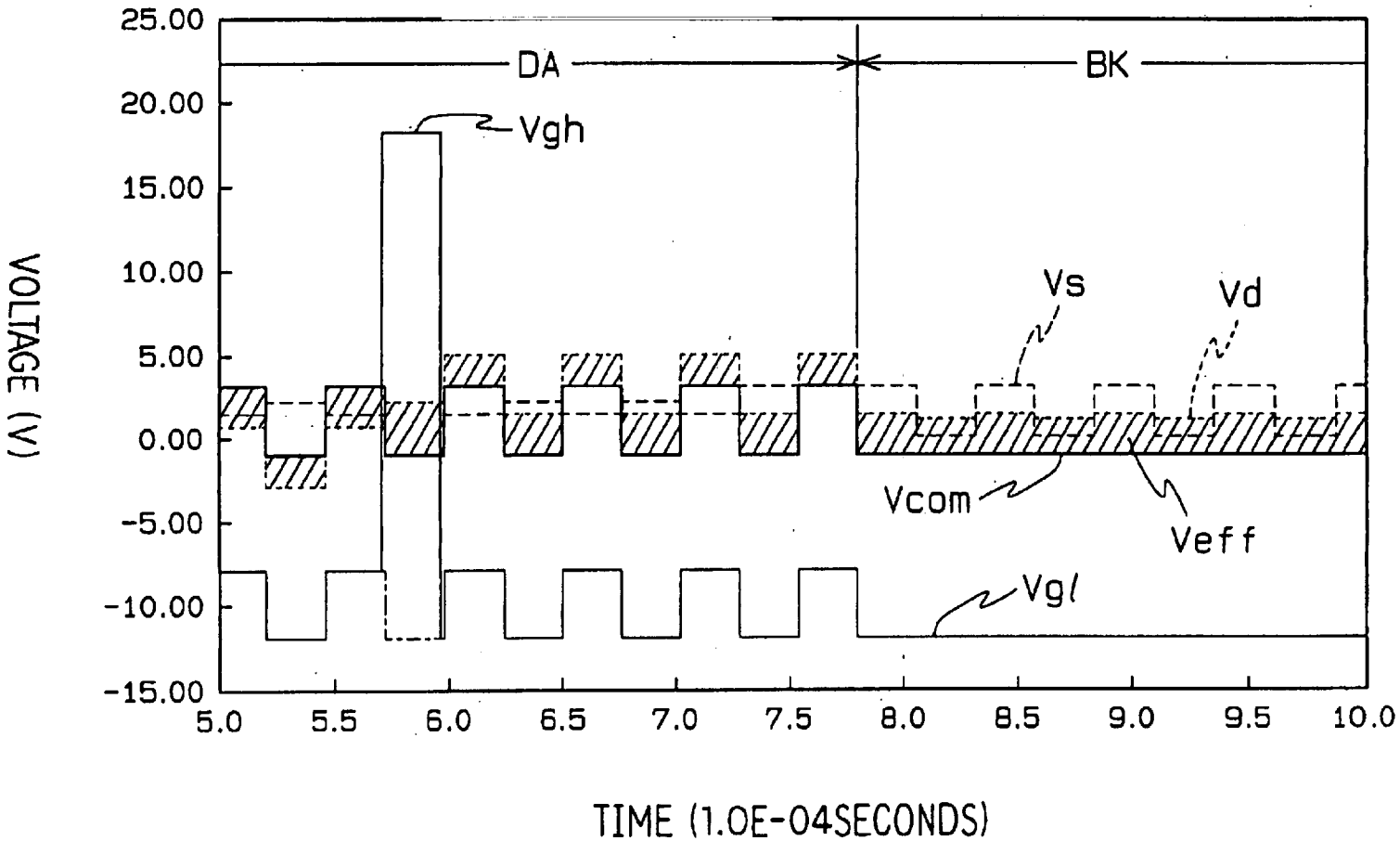
FIG. 4 is an explanatory view showing a driving waveform of the liquid crystal display apparatus of EMBODIMENT 2.
Figure 5:
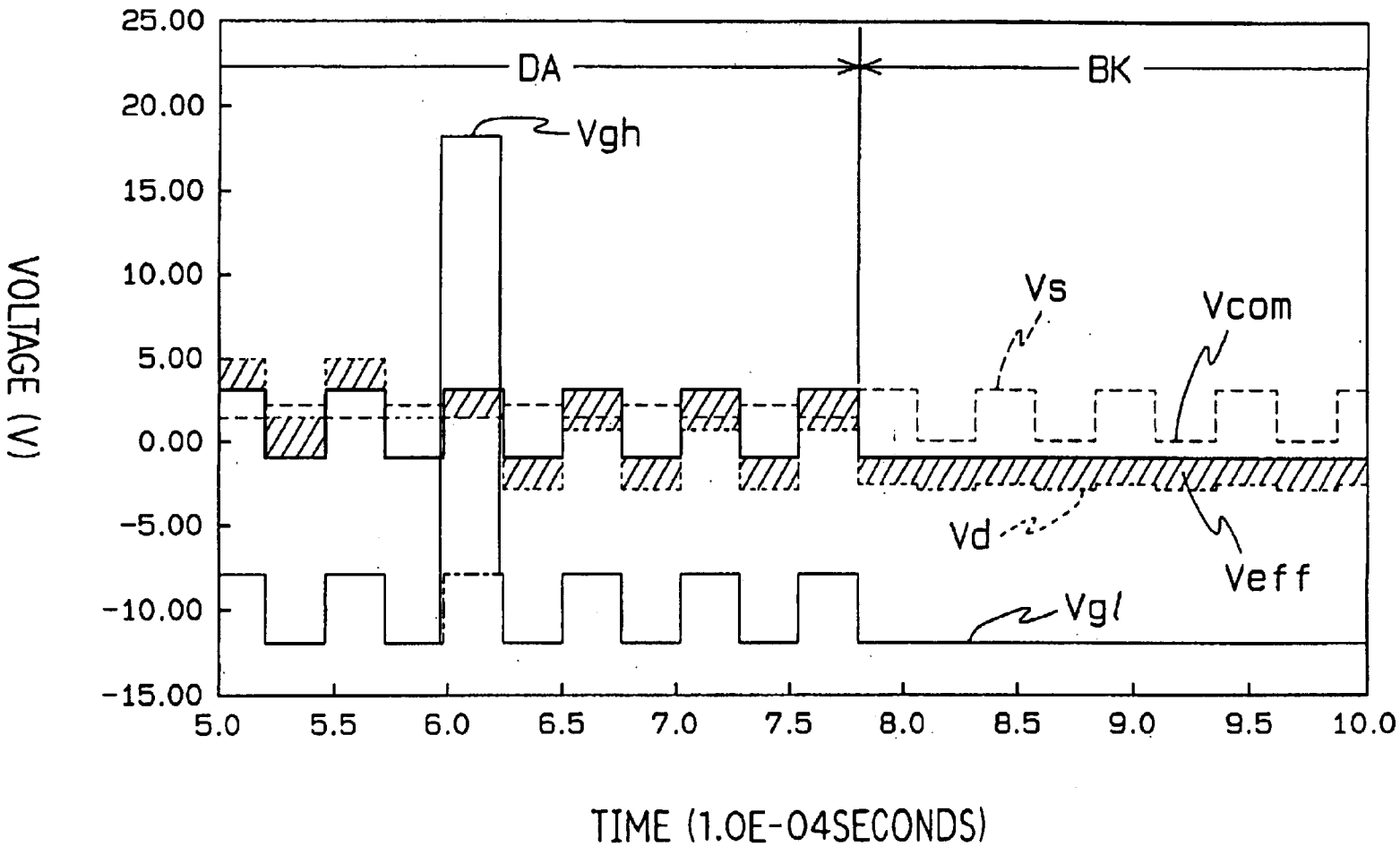
FIG. 5 is an explanatory view showing a driving waveform of the liquid crystal display apparatus of EMBODIMENT 2.

The present embodiment will now be explained in which the Vcom and Vgl remained as conventional ones and only the Vs was AC converted during the blanking period in a liquid crystal display apparatus of line common inversion method employing a panel of Cs on Gate arrangement, similarly to EMBODIMENT 1 (reference should be made to FIG. 4 and FIG. 5). By performing AC conversion, effective voltage differences between odd-numbered lines and even-numbered lines were decreased. As it can be seen from Table 1, the effective voltage difference dV1*c* between odd-

TABLE 1

| dVlc [V] at Blanking Period | | Vcom, Vgl | |
|---|---|---|---|
| | | DC | AC (in case of varying every Single Horizontal period) |
| Vs (Black level) (in case of normally white) | DC | conventional 0.524 | EMBODIMENT 1 0.199 |
| | AC (in case of varying every Single Horizontal period) | EMBODIMENT 2 0.280 | combination of EMBODIMENT 1 and EMBODIMENT 2 0.043 |
| Vs (Gray level) | DC | EMBODIMENT 4 0.374 | combination of EMBODIMENT 1 and EMBODIMENT 4 0.021 |
| | AC (in case of varying every Single Horizontal period) | EMBODIMENT 2 0.317 | combination of EMBODIMENT 1, EMBODIMENT 2 and EMBODIMENT 4 0.000 |

It can be understood from Table 1 that the effective voltage difference dV1*c* between odd-numbered lines and even-numbered lines was 0.524V in a conventional liquid crystal display apparatus while it was 0.199V in EMBODIMENT 1.

Methods for applying such Vcom and Vgl that have been alternated at a cycle of a Single Horizontal period onto the common lines and gate lines also during the blanking period will now be explained. As for the Vcom and Vgl during the data period, alternation is performed by generating polarity inversion signals PNF in the timing circuit based on signals such as HD (horizontal synchronous signal) or DENA (display data enabling signal) and respectively amplifying these. The amplified Vcom is inputted into the counter electrodes in the original form, and the Vgl is inputted into a scanning electrode driving circuit. In the scanning electrode driving circuit, the Vgh is selected for each single line and this Vgl is maintained also in the blanking period but except for the charging/discharging period. Conventionally, this PNF had been given as a DC voltage in the blanking period, while in this embodiment, the PNF is AC converted also in this period to obtain Vcom and Vgl. For performing AC conversion of the PNF (signal for determining the polarity of Vcom and Vgl) also during the blanking period, the shift register in the timing circuit is operated also during the blanking period. Therefore, alternation can be performed without the necessity of any particular means.

It should be noted that the common signal is AC converted and applied on the counter electrodes and the storage electrode signal having a frequency, phase and amplitude identical to those of the common signal is applied on the numbered lines and even-numbered lines was decreased to 0.280V in EMBODIMENT 2 while it was 0.524V in a conventional liquid crystal display apparatus. In case the AC amplitude was fixed to Gray level in this embodiment, the dV1*c* was 0.317V.

In order to apply the Vs that has been alternated at a cycle of a Single Horizontal period onto source lines also during the blanking period, Vs that has been alternated at a cycle of a Single Horizontal period in a timing circuit in which a shift register within the timing circuit is operated during the vertical blanking period was generated during the blanking period and applied on the source lines, similarly to EMBODIMENT 1.

Embodiment 3

Concerning the AC conversion of Vcom and Vgl in EMBODIMENT 1 and the AC conversion of Vs in EMBODIMENT 2, it was set in EMBODIMENT 1 and EMBODIMENT 2 that these were varied during the blanking period per 1H. However, by applying Vcom, Vgl and Vs signals which voltages have been varied for more than once during the blanking period without particularly relying on frequency, effective voltage differences can be decreased. For this reason, a variable common signal was applied on counter electrodes and Vgl was generated as a variable storage electrode signal that varies synchronously with the variable common signal to be of same polarity as the common signal and by an identical amplitude and is applied on the gate lines. However, in this embodiment, Vcom (variable common signal), Vgl (variable gate OFF signal) and Vs (variable source signal) which voltages were varied at least once during the blanking period were generated by a timing circuit in which a polarity inverting signal was inverted at least once during the blanking period.

Embodiment 4

Figure 6:
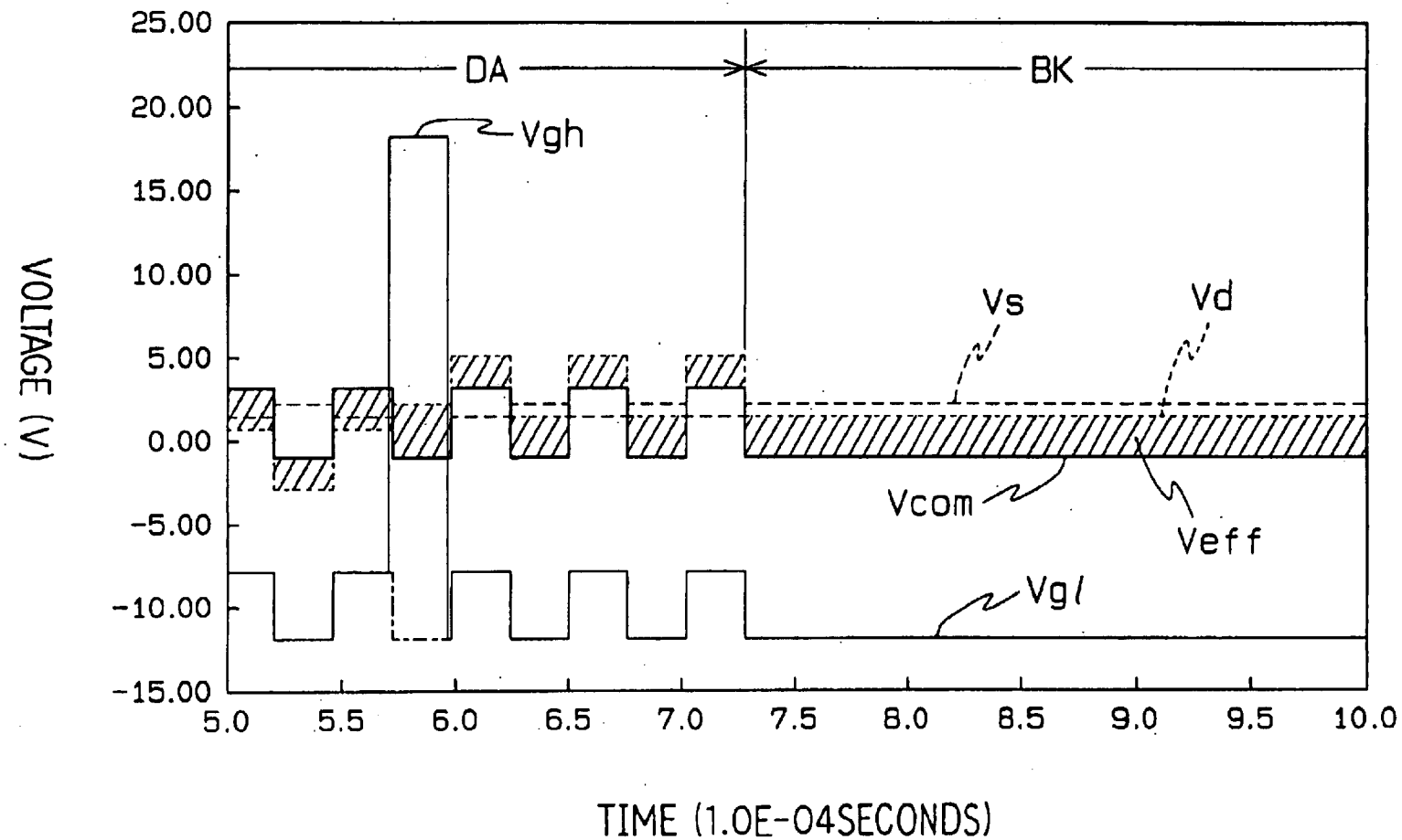
FIG. 6 is an explanatory view showing a driving waveform of the liquid crystal display apparatus of EMBODIMENT 4.
Figure 7:
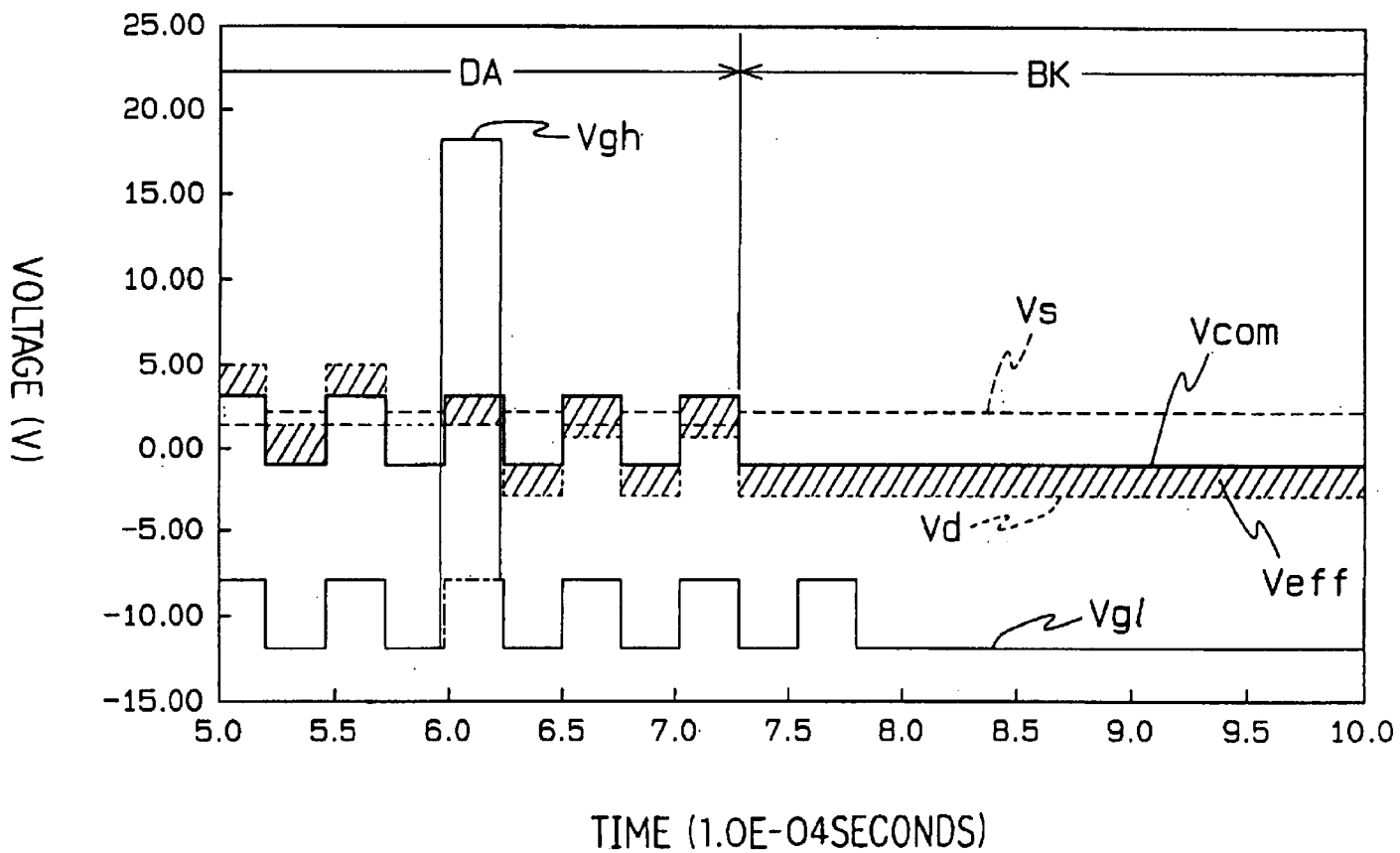
FIG. 7 is an explanatory view showing a driving waveform of the liquid crystal display apparatus of EMBODIMENT 4.

The present embodiment will now be explained in which the Vcom and Vgl remained as conventional ones and the DC level of the Vs was set to be at Gray level during the blanking period in a liquid crystal display apparatus of line common inversion method employing a panel of Cs on Gate arrangement, similarly to EMBODIMENT 1 to EMBODIMENT 3 (reference should be made to FIG. 6 and FIG. 7). Since the Vs is usually fixed to a black (in case of normally white mode) DC level having large amplitudes, differences between Veff of odd-numbered and even-numbered lines owing to signal coupling is large. In this embodiment, the Vs has been fixed to a Gray level in which the amplitude was smaller than that of a black level whereby the effective voltage difference dV1*c* between odd-numbered lines and even-numbered lines could be decreased to 0.374V than compared to 0.524V in a conventional liquid crystal display apparatus as it is shown in Table 1. Generating a Vs which DC level is a Gray level is performed as follows:

Since an output corresponding to a last gate line is usually maintained for the Vs during the blanking period, data for the Gray level are generated in the timing circuit as data for a line following the last line and are input into the display signal circuit, whereby the source signal during the blanking period is maintained at a DC voltage of Gray level, and a Gray level source signal is generated. Generation of other signals and control were performed through similar methods using the same driving circuit as described in the afore-mentioned EMBODIMENT 1 or EMBODIMENT 2.

Embodiment 5

Figures 9A, 9B, 9C, 9D, 9E, 9F:
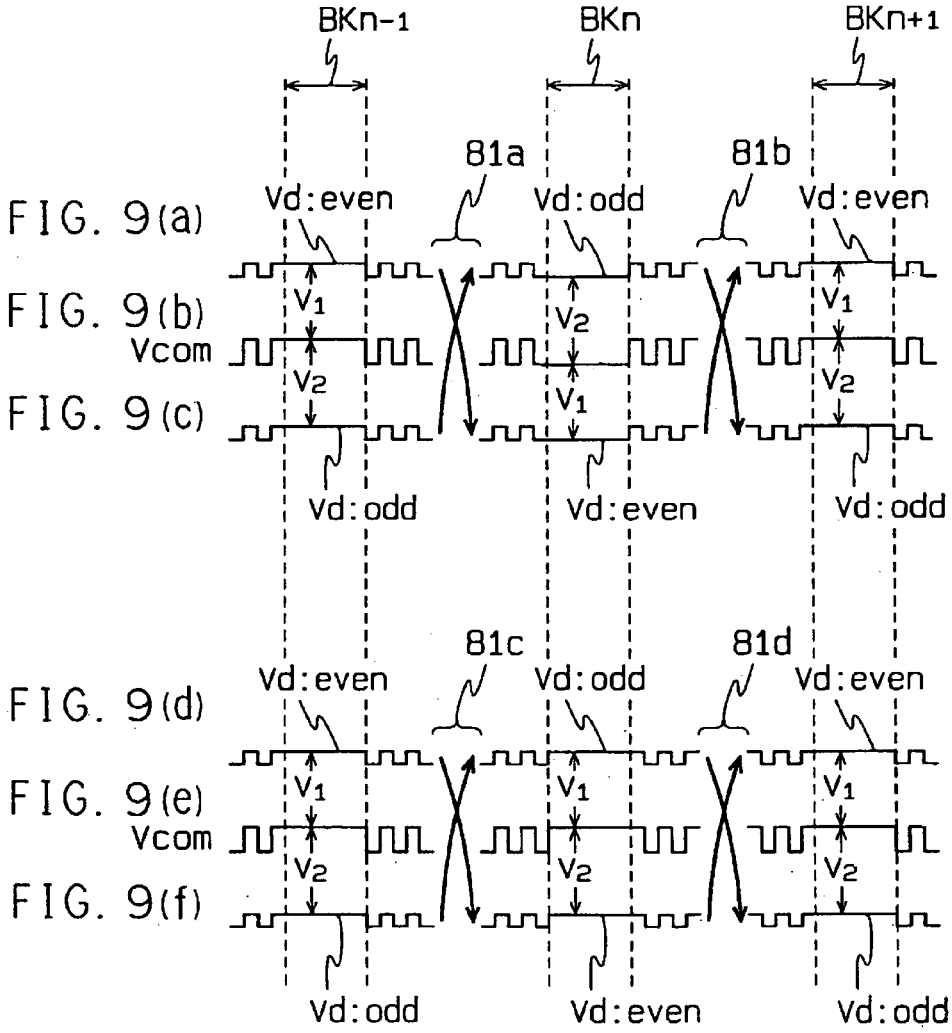
FIG. 9 is an explanatory view showing a driving waveform of the liquid crystal display apparatus of EMBODIMENT 5.

FIG. 8 and FIG. 9 are diagrams showing, in details, comparison between generation of signals wherein Vcom of a n-th blanking period BKn and that of a n+1-th blanking period BKn+1 are set to be of same polarity (FIGS. 9(*d*) to (*f*)) and a conventional one (FIGS. (a) to (c), wherein Bkn and BKn+1 are of opposite polarity), wherein Pf denotes a single frame (50 to 70 Hz), Vsync a vertical synchronizing signal (or VD), DENA a display data enabling signal, PNF a signal for determining the polarity of Vcom and Vgl, Vd:odd an electric potential of an arbitrary drain electrode among the odd-numbered lines of the gate, Vd:even an electric potential of an arbitrary drain electrode among the even-numbered lines of the gate, and 81*a*, 81*b*, 81*c* and 81*d* recharge, respectively. Further, $V_1$ denotes a case in which the effective voltage Veff becomes small and $V_2$ in which the effective voltage Veff becomes large, wherein $V_1$ indicates that the luminance is "bright" and $V_2$ that the luminance is "dark". It can be understood from the drawings that the gate even-numbered lines became both "bright" in luminance in BKn and BKn+1 in case the Vcom of BKn and that of Bkn+1 are of opposite polarity (while the odd-numbered lines were all "dark") while the gate even-numbered lines became "bright" at BKn and "dark" at BKn+1 (while the odd-numbered lines were "dark" at BKn and "bright" at BKn+1) in case the Vcom were of same polarity as in the present embodiment.

In a liquid crystal display apparatus of line common inverting method, voltage levels of Vcom and Vgl of blanking periods BKn and BKn+1 were conventionally determined by an electric potential of a last stage during the data period as shown in FIGS. 9(*a*) to 9(*c*) whereby the polarity during the blanking period became opposite at BKn and BKn+1. In this embodiment, effective voltage differences between odd-numbered lines and even-numbered lines could be decreased by making the polarity of BKn and BKn+1 identical and thus to achieve effects similar to those of EMBODIMENT 1 to EMBODIMENT 4. Therefore, a common signal as well as a gate OFF signal having a frequency, phase and amplitude identical to those of the common signal were generated to be of same polarity by fixing the polarity inverting signal either to H or L during each of the vertical blanking period, and the common signal of same polarity was applied on the counter electrodes and the gate OFF signal on the gate lines, respectively, during the vertical blanking period. At this time, the polarity of BKn and BKn+1 were made identical by fixing the PNF during the blanking period to either H or L in the timing generating circuit. Generation of other signals and control were performed through similar methods using the same driving circuit as described in the afore-mentioned EMBODIMENT 1 to EMBODIMENT 3 or that of EMBODIMENT 4.

Embodiment 6

Figure 10:
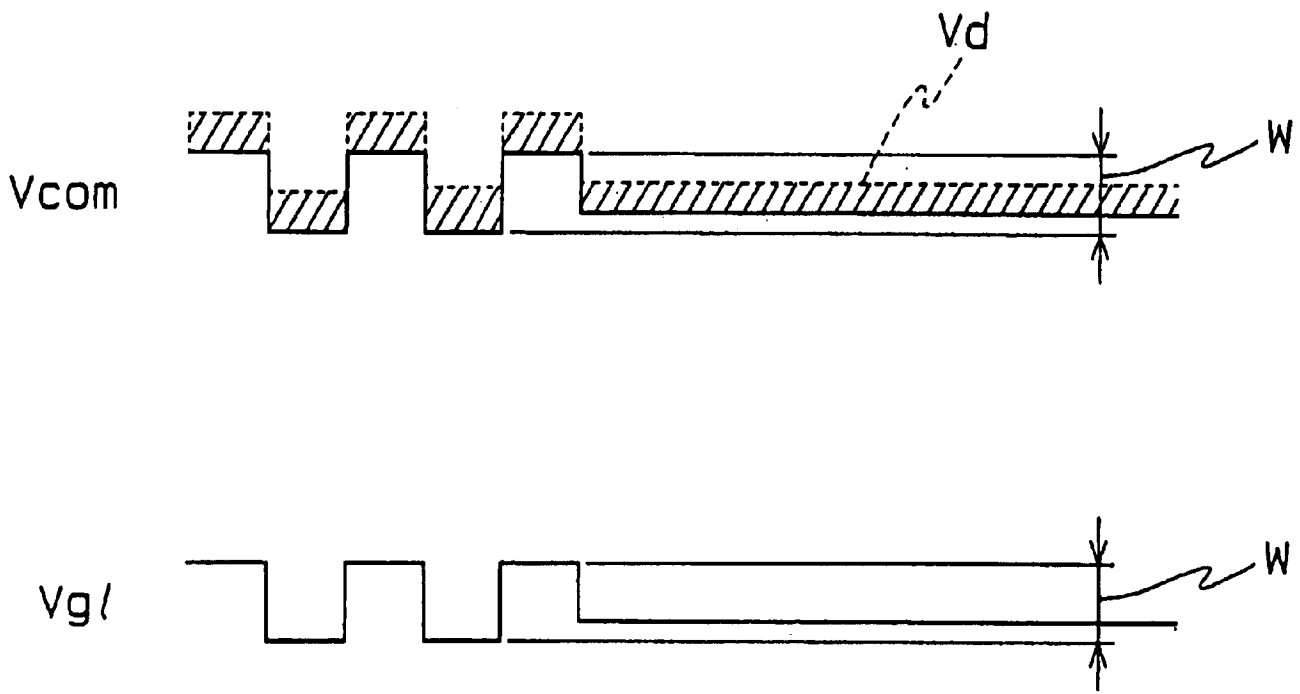
FIG. 10 is an explanatory view showing a driving waveform of the liquid crystal display apparatus of EMBODIMENT 6.

In the liquid crystal display apparatus of line common inverting method employing a panel of Cs on Gate arrangement, it is also possible to use Vs as conventional ones and to apply Vcom and Vgl as signals having intermediate electric potentials of amplitude W (reference should be made to FIG. 10) during the blanking period. By fixing the Vcom and Vgl during the blanking period to assume intermediate electric potentials of amplitudes, effective voltage differences between odd-numbered lines and even-numbered lines could be decreased and similar effects as those of EMBODIMENT 1 to EMBODIMENT 5 could be achieved. In this case, the intermediate electric potential may be an electric potential between a maximum peak value and a minimum peak value of the amplitude of each of the signals during the data period. Vcom and Vgl are respectively set to be at an intermediate electric potential of the amplitude by setting an amplification rate to zero in a circuit for generating Vcom and Vgl by amplifying PNF. Generation of other signals and control were performed through similar methods using the same driving circuit as described in the afore-mentioned EMBODIMENT 1 to EMBODIMENT 3 or that of EMBODIMENT 4.

Embodiment 7

Figure 11:
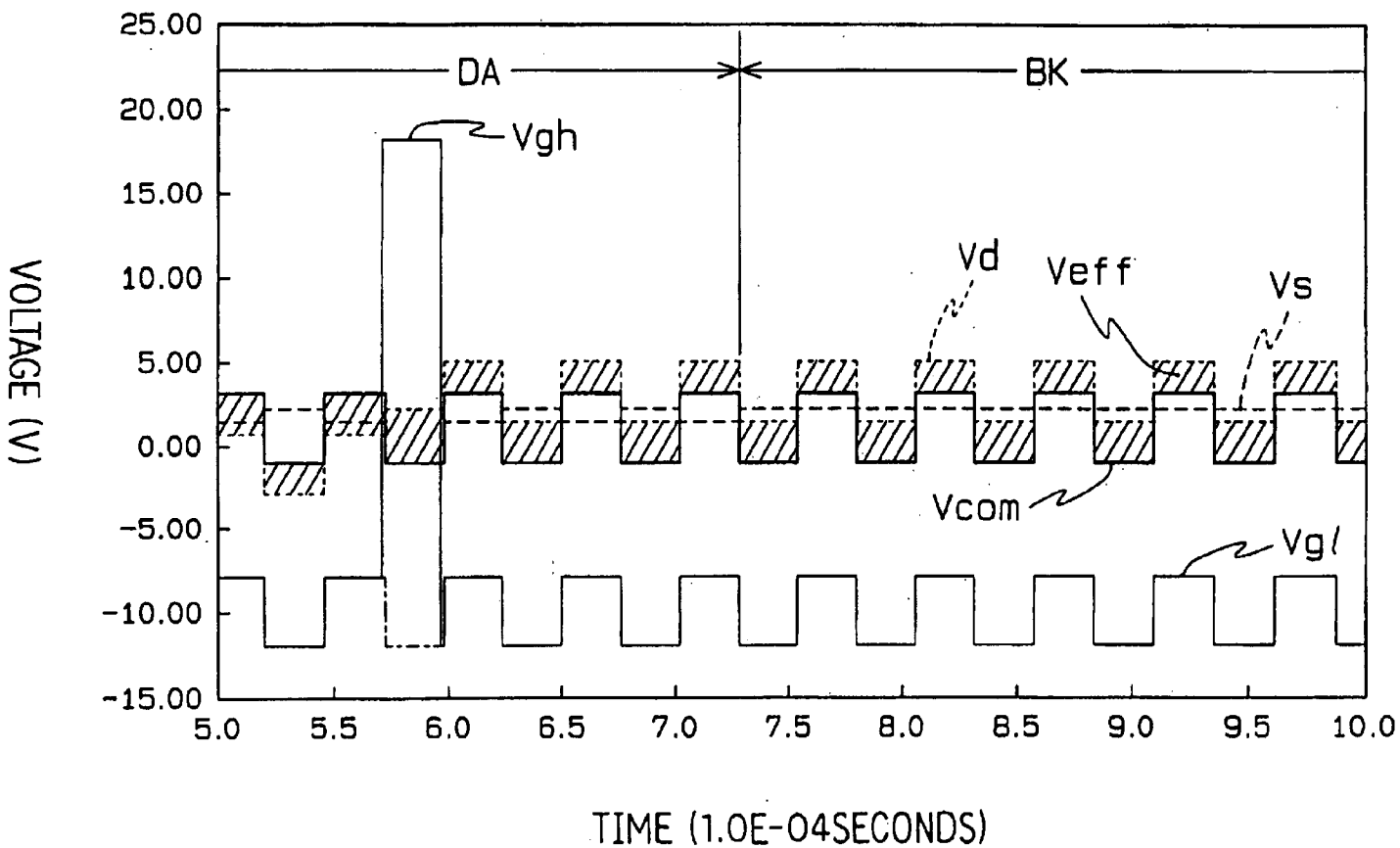
FIG. 11 is an explanatory view showing a driving waveform of the liquid crystal display apparatus of EMBODIMENT 7.
Figure 12:
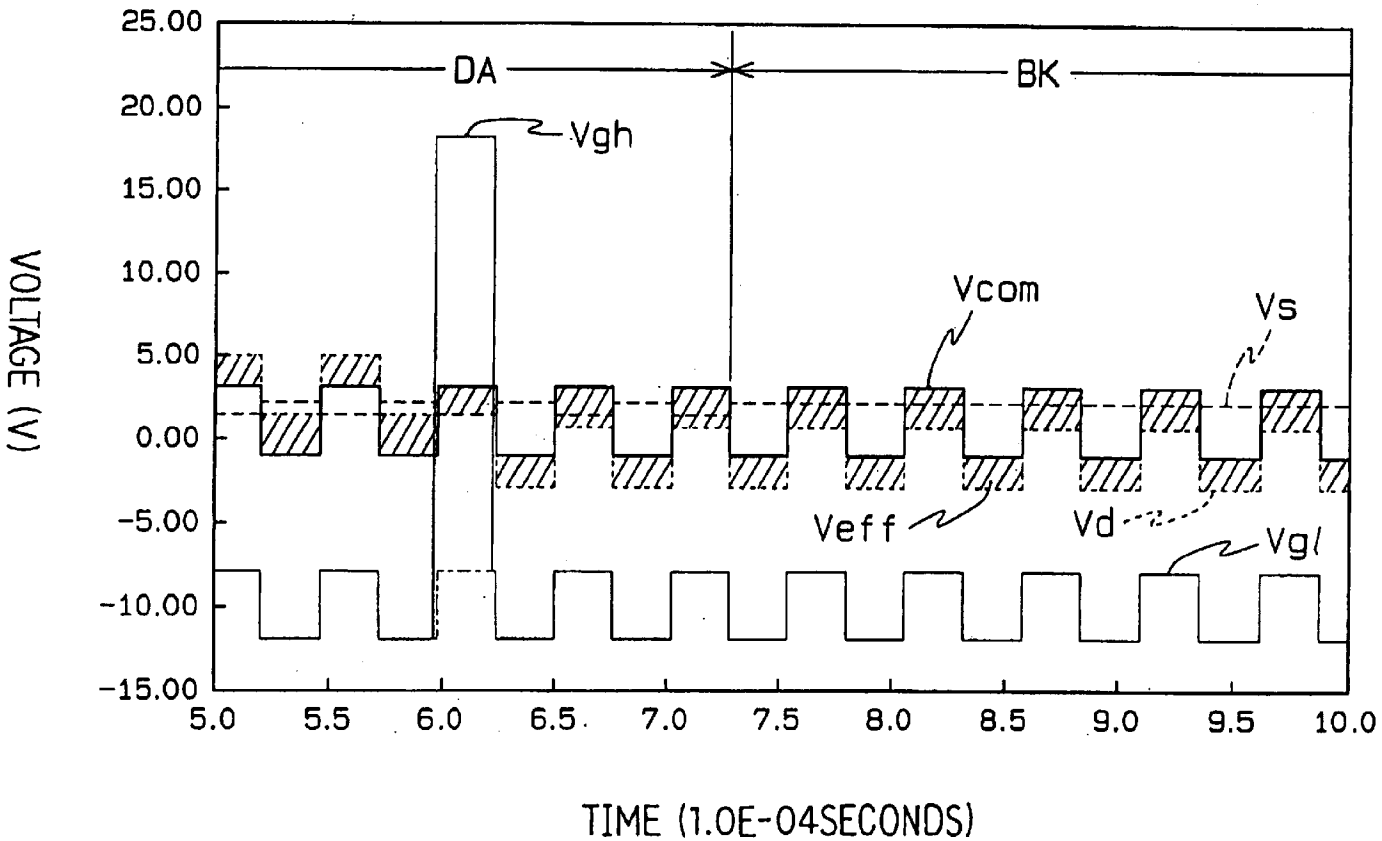
FIG. 12 is an explanatory view showing a driving waveform of the liquid crystal display apparatus of EMBODIMENT 7.
Figure 13:
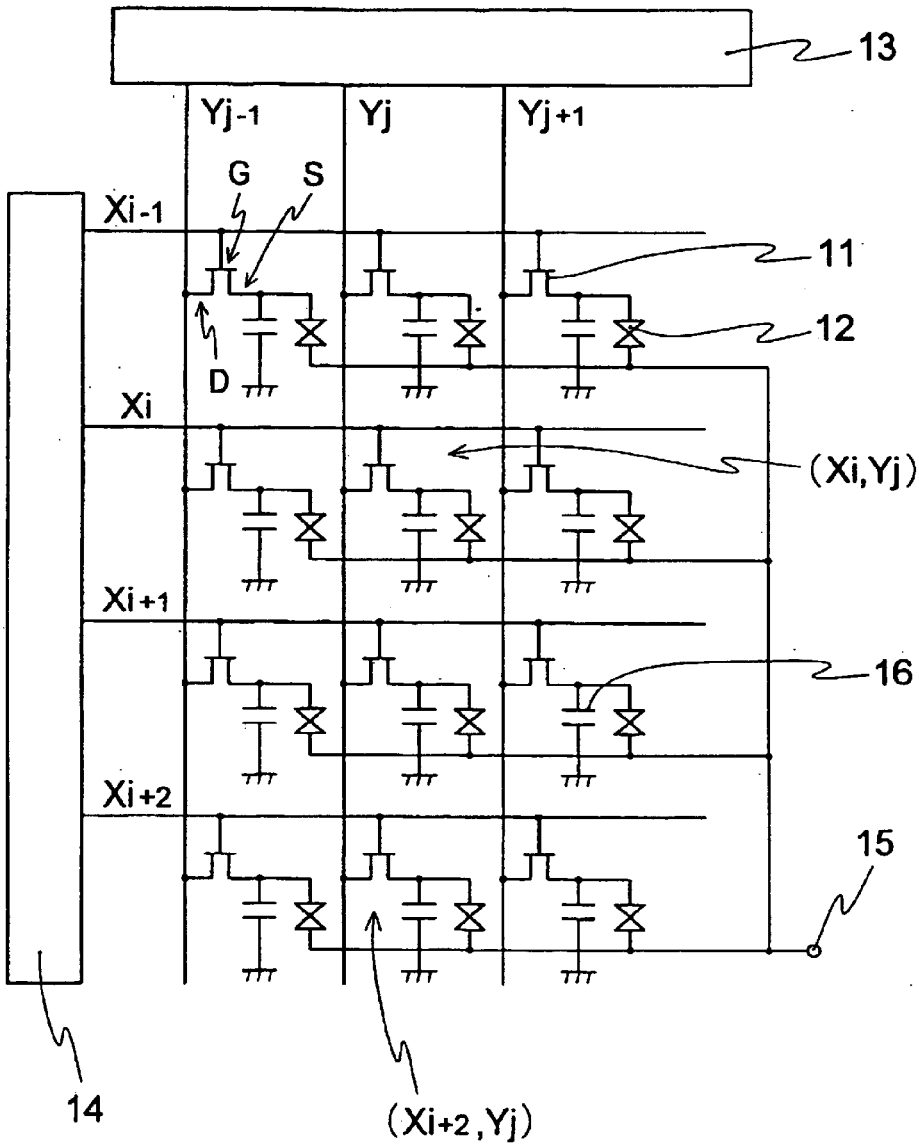
FIG. 13 is an explanatory view showing a driving waveform of the conventional liquid crystal display apparatus.
Figure 14:
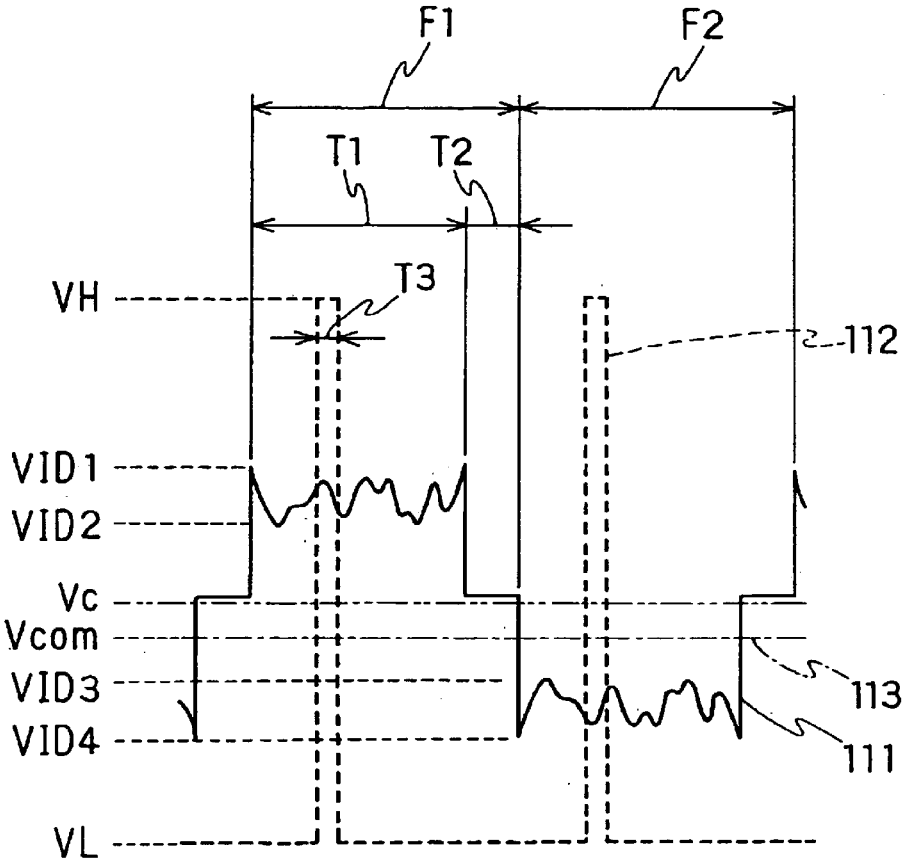
FIG. 14 is an explanatory view showing a driving waveform of the conventional liquid crystal display apparatus.
Figure 15:
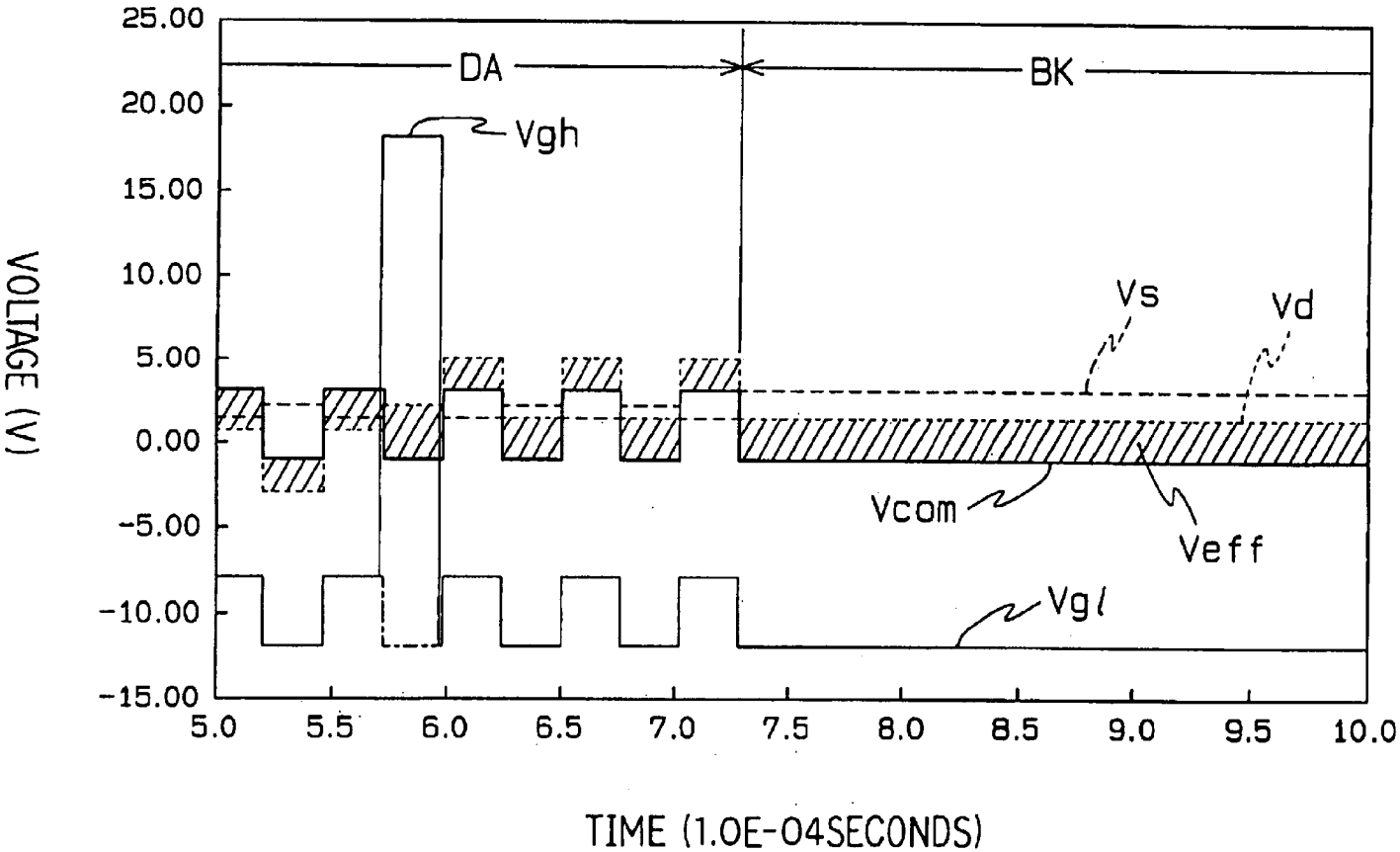
FIG. 15 is an explanatory view showing a driving waveform of the conventional liquid crystal display apparatus.
Figure 16:
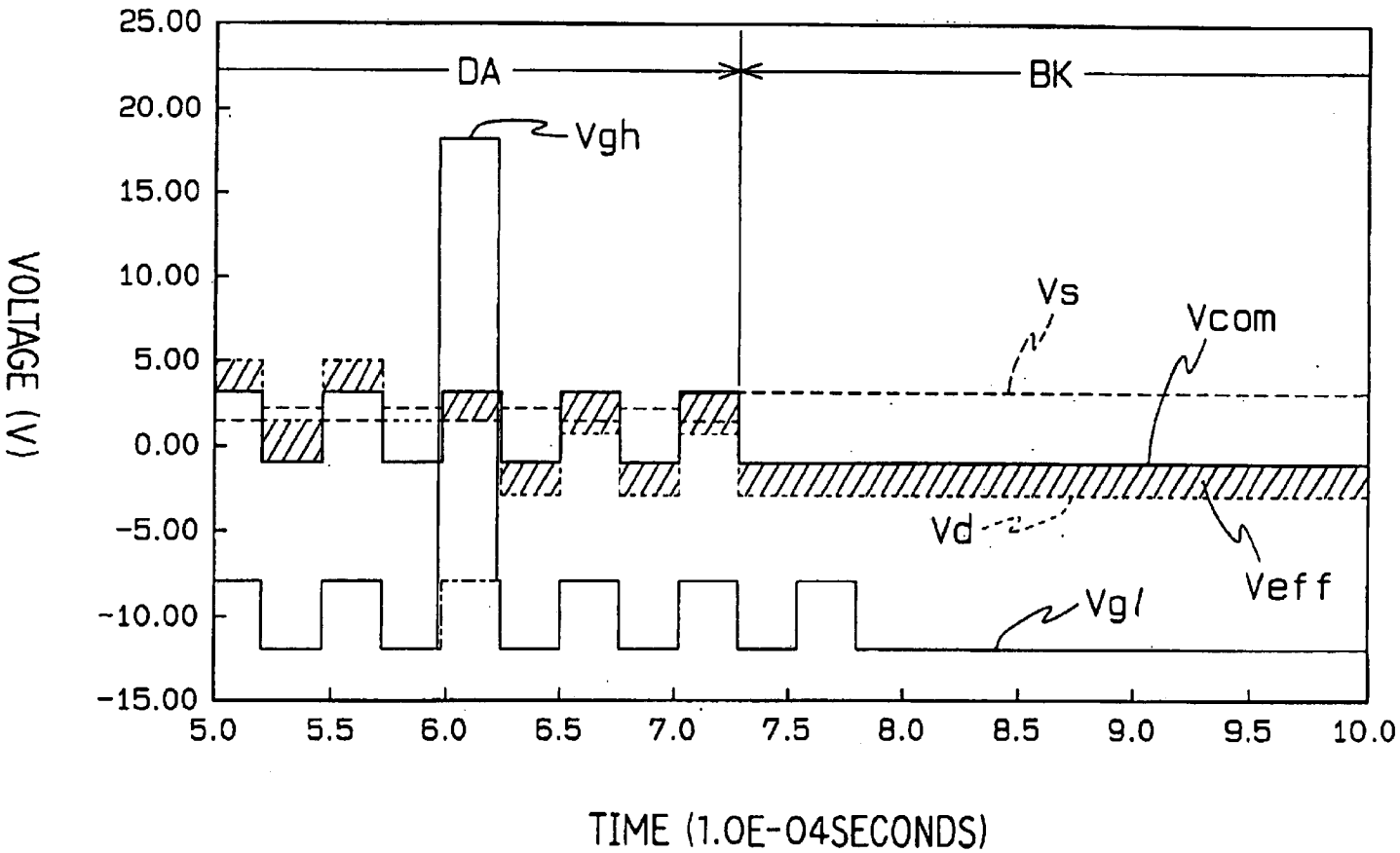
FIG. 16 is an explanatory view showing a driving waveform of the conventional liquid crystal display apparatus.
Figure 17:
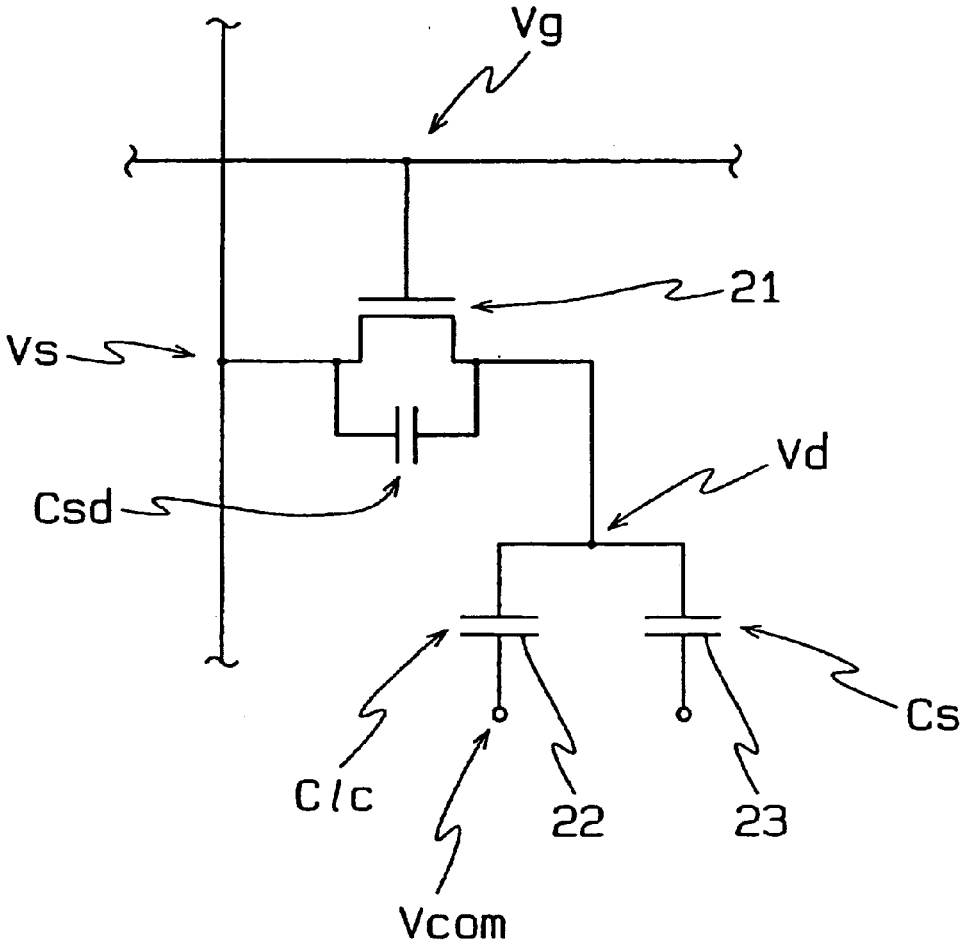
FIG. 17 is an explanatory view showing a driving waveform of the conventional liquid crystal display apparatus.

In EMBODIMENT 7 (references should be made to FIG. 11 and FIG. 12), EMBODIMENT 1 and EMBODIMENT 4 were combined, that is, Vcom and Vgl were AC converted and the DC level of Vs was set to Gray level. In this case, the effective voltage difference dVLC between odd-numbered lines and even-numbered lines was decreased to 0.021V as can be seen from Table 1. In case EMBODIMENT 1 and EMBODIMENT 2 are combined, the effective voltage difference dVLC between odd-numbered lines and even-numbered lines became 0.043V as can be seen from Table 1, and further, in case of combining EMBODIMENT 1, EMBODIMENT 2 and EMBODIMENT 4 for performing AC conversion of Vs at Gray level and AC conversion of Vcom and Vgl, the same value is decreased to 0.000V (in the display condition, all pixels displayed Gray level). In this manner, from among liquid crystal display apparatuses of line common inverting method employing a panel of Cs on Gate arrangement, a liquid crystal display apparatus embodying combinations of a plurality of embodiments selected from EMBODIMENT 1, EMBODIMENT 2 and EMBODIMENT 4 as shown in Table 1 (e.g. EMBODIMENT 1 and EMBODIMENT 2, EMBODIMENT 1 and EMBODIMENT 4 or EMBODIMENT 1, EMBODIMENT 2 and EMBODIMENT 4) was capable of decreasing the effective voltage difference between odd-numbered lines and even-numbered lines to achieve effects similar to those of EMBODIMENT 1 to EMBODIMENT 6.

Embodiment 8

Similarly to EMBODIMENT 7, the effective voltage difference between odd-numbered lines and even-numbered lines could also be decreased by combining at least two of EMBODIMENT 1 to EMBODIMENT 6 (e.g. EMBODIMENT 2 and EMBODIMENT 5, EMBODIMENT 2 and EMBODIMENT 4, EMBODIMENT 2 and EMBODIMENT 6 or EMBODIMENT 4 and EMBODIMENT 6).

Embodiment 9

In a line common inverting method having an array arrangement which is a common Cs arrangement in which storage capacitances are provided by the common lines, the storage capacitance (Cs) electrodes are of same electric potential as those of the Vcom. Therefore, by making Vcom correspond instead of Vgl in EMBODIMENT 1 to EMBODIMENT 8, similar effects as those of EMBODIMENT 1 to EMBODIMENT 8 can be achieved.

According to the present invention, luminance differences that are generated per each line of gate lines can be decreased in a liquid crystal display apparatus of line common inverting method.

What is claimed is:

1. A liquid crystal display apparatus comprising:

a timing circuit in which a DC level of a variable source signal is set to a Gray level for a line following a last line, the Gray level having an amplitude smaller than that of a black level, and wherein the Gray level variable source signal is applied on source lines during the vertical blanking period.

2. A method for driving a liquid crystal display apparatus comprising:

applying a variable source signal having a DC level set at a Gray level electric potential on source lines during a vertical blanking period for decreasing effective voltage differences between odd-numbered lines and even-numbered lines and for decreasing luminance differences per gate line, the Gray level having an amplitude smaller than that of a black level.

* * * * *